United States Patent [19]

Fitzwater

[11] 4,443,910

[45] Apr. 24, 1984

[54] ABOVE-THE-FLOOR ADAPTOR FOR UPRIGHT VACUUM CLEANER

[75] Inventor: Edwin Fitzwater, Rahway, N.J.

[73] Assignee: General Signal Corporation, Stamford, Conn.

[21] Appl. No.: 393,275

[22] Filed: Jun. 29, 1982

[51] Int. Cl.[3] ..... A47L 5/32

[52] U.S. Cl. ..... 15/337

[58] Field of Search ..... 15/334, 335, 337

[56] References Cited

U.S. PATENT DOCUMENTS

| | | | |
|---|---|---|---|
| 2,046,658 | 7/1936 | Smellie | 15/334 |
| 2,080,480 | 5/1937 | Hoover | 15/337 |
| 2,682,680 | 7/1954 | Trimble | 15/337 X |
| 3,321,794 | 5/1967 | Jepson et al. | 15/337 |
| 4,225,999 | 10/1980 | Martinec et al. | 15/337 X |

*Primary Examiner*—Chris K. Moore

*Attorney, Agent, or Firm*—Jeffrey S. Mednick; Milton E. Kleinman

[57] ABSTRACT

A vacuum cleaner for selective conversion between on-the-floor and above-the-floor cleaning. The basic upright vacuum cleaner includes a joint with a through passageway connecting the handle to the floor nozzle and through which the suction air passes. The joint includes a wall with a selectively openable passageway into which an adaptor, coupled to a hose, may be selectively inserted. Insertion of the adaptor cuts off the suction path to the floor nozzle and creates a suction path through the adaptor and associated hose to a wand and cleaning tool.

13 Claims, 6 Drawing Figures

ABOVE-THE-FLOOR ADAPTOR FOR UPRIGHT VACUUM CLEANER

BACKGROUND OF THE INVENTION

This invention relates to vacuum cleaners and more particularly to an adaptor which may be attached to an upright vacuum cleaner to permit a flexible hose and extension tools to be connected to the vacuum cleaner to permit above-the-floor cleaning.

Vacuum cleaners of the upright variety generally include a head member having an elongated nozzle mouth or opening at the bottom thereof through which air is sucked by an air-moving motor fan unit. Frequently, a rotary brush is mounted adacent to the nozzle mouth for contacting a floor surface to agitate and loosen the dirt so that it may be sucked free of the surface. Usually, wheels for rolling the head of the cleaner on the floor are provided and the head is guided by means of a handle. The most common household cleaning chore involves the cleaning of carpeting and rugs and an upright cleaner is normally best suited for such usage. However, there is frequent requirement for above-the-floor cleaning of such items as furniture, walls, ceilings, draperies, general dusting and other chores with which the householder is all too familiar. A conventional upright cleaner is useless for these functions. A canister type vacuum cleaner is normally used for such above-the-floor cleaning chores and includes a hose connected to the canister cleaner which provides the suction means. The other extremity of the hose is adapted to selectively receive any one of a plurality of interchangeable accessory nozzles.

In order to minimize the need for a household to have these two types of cleaners, there have been attempts to convert one type of cleaner to the use usually reserved for the other type. For example, canister cleaners have been provided with motor means associated with the floor nozzle for driving a rotary brush to simulate the action of an upright cleaner. In addition, attachments have been provided for an upright cleaner to convert it to above-the-floor cleaning.

U.S. Pat. No. 2,996,748 issued Aug. 22, 1961 to Gidezendanner teaches an attachment adaptor for an upright vacuum cleaner that requires coupling an adaptor to the bottom of the upright cleaner floor nozzle using a cover plate arranged to cover the mouth of the suction nozzle. A resilient strap is also used to connect the adaptor to engage the upright handle to secure the assembly. By present standards, this is an awkward and inconvenient technique.

U.S. Pat. No. 3,273,194 issued Sept. 20, 1966 to Jepson, et at discloses an upright cleaner which does not include a power driven brush in the floor nozzle. When it is desired to convert this cleaner to use an attachment for above-the-floor cleaning chores, a separable cap is removed from the rear and a hose connector is inserted into the opening from which the separable cap was removed. Affixed to the connector is a pair of floor engaging legs and the operating handle is tilted backwards until the legs engage the floor. This combination is provided in order to allow movement of the cleaner in response to a pull exerted on the hose. This cleaner is an improvement over prior art devices but is somewhat unstable in operation due to the fact that the hose plugs into the cleaner at a level appreciably above floor level and therefore, in response to a pull on the hose, there is a probability of tipping over the cleaner. In addition, there is a probability of misplacement and loss of the separable cover.

U.S. Pat. No. 3,300,806 issued Jan. 31, 1967 to Ripple discloses an upright vacuum cleaner including means for attaching a hose for above-the-floor cleaning. This system requires an auxiliary or conduit hose between the floor nozzle and the housing cover surrounding the handle together with valve means for controlling the flow of air as required for the two different types of operation.

U.S. Pat. No. 3,869,751 issued Mar. 11, 1975 to Boyd et al discloses a convertible cleaner which requires a manually operable valve means for switching the suction from the floor nozzle to the plugged in hose. The patent teaches an interlock that requires the user to adjust the valve to the required position for upright cleaner use prior to removal of the hose which adapts the cleaner for above-the-floor use.

U.S. Pat. No. 4,008,505 issued Feb. 22, 1977 to Clowers discloses a convertible cleaner which provides a bulky apparatus that is connected to the bottom side of the floor nozzle of the upright cleaner. This technique is similar to some of the earliest attempts to provide conversion between upright and canister cleaners.

SUMMARY OF THE INVENTION

The present structure provides a simple economical and convenient means for converting an upright vacuum cleaner, of the type which includes a floor nozzle which may have a power driven rotary brush, to a cleaner suitable for above-the-floor cleaning chores. The floor nozzle includes suction passageways which lead to the hollow interior of the operating handle. Coupled to the handle is a motor driven suction means and means for filtering the air to remove entrained dirt. The floor nozzle is coupled to the handle by means of a joint which may provide for relative movement between the joint and the floor nozzle. The joint will usually provide for adjustment of the angle between the handle and the floor by some sort of swivel action. Accordingly, the joint is sometimes referred to as a swivel, or swivel joint. The joint has an opening on the rear side thereof which is normally maintained in a closed position by a hinged cover coupled thereto. When the hinged cover is opened by releasing a latch means an adaptor coupled to the end of a hose may be plugged into the opening in the swivel joint. The adaptor is coupled to the swivel joint by latch means. With the adaptor plugged into and latched to the swivel, the adaptor has a portion which serves to close the passageway between the orifice of the floor nozzle and the suction means while leaving open a passageway from the hose through the adaptor to the swivel and the suction means. Thus, by the mere act of plugging in the adaptor, the suction path is appropriately changed without any requirement for setting separate knobs or valves.

As stated, the swivel joint includes an opening into which the adaptor is selectively plugged. When the adaptor is not inserted into the opening, it is closed by a hinged cover permanently affixed to the swivel thereby preventing misplacement or loss of the cover. The cover pivoted to the swivel joint may be configured in a manner to provide minimum turbulence to the air flow when the cover is closed.

The vacuum cleaner with which this invention may be used, may include a power driven brush in the floor nozzle. If such is the case, power to the brush should be disconnected with the cleaner is adapted for above-the-floor cleaning. The latch of the adaptor includes a cord grip for gripping the disconnected wire from the floor nozzle motor.

It is the general object of this invention to provide an upright vacuum cleaner that is economically and readily convertible for use as an above-the-floor cleaner.

It is a more specific object of the invention to provide an upright vacuum cleaner which provides an opening into which an adaptor may be inserted.

It is another object of the invention to provide the features aforedescribed without requiring the adjustment of any valves.

It is another object of the invention to provide for the described convertability without the inclusion of any separable parts which might be misplaced or lost.

It is another object of the invention to automatically alter the suction passageways in response to insertion of the adaptor.

It is another object of the invention to connect the adaptor close to the suction source in order to minimize leakage or suction losses.

It is another object of the invention to locate the opening for the adaptor in a convenient location and yet one which has as low a center of gravity as practical so that there is reduced possibility of tipping the upright vacuum cleaner in response to pulling on the hose.

It is another object of the invention to provide a latch such that the cover and the adaptor latch to the same member on the joint.

It is another object of the invention to provide means for securing a wire which might otherwise drag on the floor and become entangled with the cleaner as it is moved about.

Still another object of the present invention is to provide a new and improved convertible vacuum cleaner which substantially overcomes the disadvantages of the described prior art and which provides a structure characterized by its reliability, ruggedness, ease and convenience of use, simplicity and low cost combined with versitility and adaptability.

BRIEF DESCRIPTION OF THE DRAWING

To permit incissive and detailed analysis of the function and characteristics of the various components, several figures and views are provided. The figures disclose one form of the invention and is not meant, in any way, to delimit its scope, it is rather so drawn as an aid to an understanding of the characteristics and principles of the invention. Like parts are given are given like identification numbers in all views in which.

DESCRIPTION OF THE PREFERRED EMBODIMENT

Figure 1:
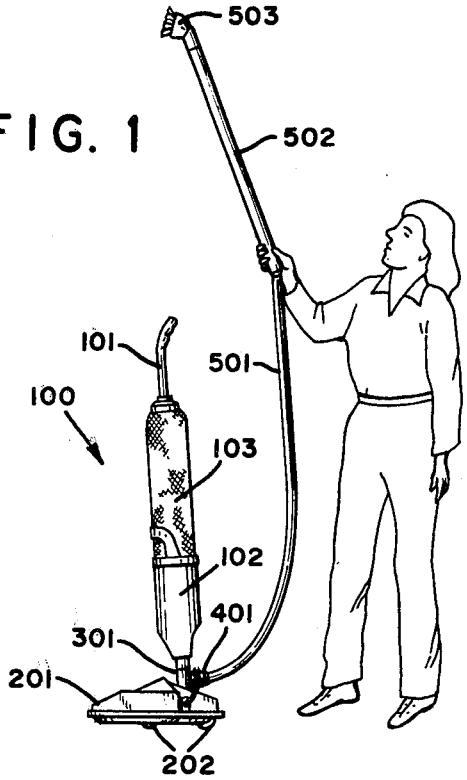
FIG. 1 is a view of an upright cleaner adapted for, and in use, as an above-the-floor cleaner.

Considering first FIG. 1, there will be seen therein an upright vacuum cleaner indicated generally as 100 which includes a floor nozzle 201, a handle 101, a motor section 102, and a filter bag 103. The floor nozzle 201 is typically provided with rollers 202 for gliding along the surface being cleaned. Typically, the floor nozzle 201 will also include a motor (not shown) for driving a rotary brush (not shown) for loosening the dirt so that it may be more readily and effectively picked up by the suction action of the motor in the motor section 102. It should be understood that the handle 101 extends through the filter section 103 and motor section 102 where it connects with a swivel joint element 301. The swivel element 301 is coupled to the floor nozzle 201 by a means that provides for angular motion of the swivel 301 with respect to the floor nozzle 201. In a manner that is well known to those skilled in the art, the floor nozzle 201 includes a longitudinal orifice through which air and entrained dirt is sucked in response to the suction action provided by the motor section 102 and is guided through passageways including the hollow interior of the swivel 301 and through the motor section into the filter section wherein the entrained dirt is filtered out and collected.

As may be seen in FIG. 1, the operator of the upright cleaner 100 has coupled thereto a hose 501 which is connected to a wand 502 held by the operator and which has a cleaning tool 503 connected to the remote end of the wand 502. Different types of cleaning accessories may be attached to the wand 502 in place of the cleaning tool 503 permitting the operator to perform a wide variety of cleaning chores. The end of the hose 501 near the cleaner 100 has an adaptor 401 which plugs into the swivel 301. As will be shown hereinafter, when the adaptor 401 is plugged into the swivel 301, the suction through the orifice of the floor nozzle 201 is closed and a new suction path beginning at the cleaning tool 503 and extending through the wand 502 and hose 501 and through the adaptor 401 and swivel 301 through the motor section 102 to the filter 103 is created.

The remaining figures will deal more particularly with the swivel 301 and adaptor 401 and illustrate the manner in which they cooperate with each other and the other elements for converting the cleaner 100 between an upright cleaner for use in cleaning floors and an above-the-floor cleaner for cleaning other areas.

Figure 2:
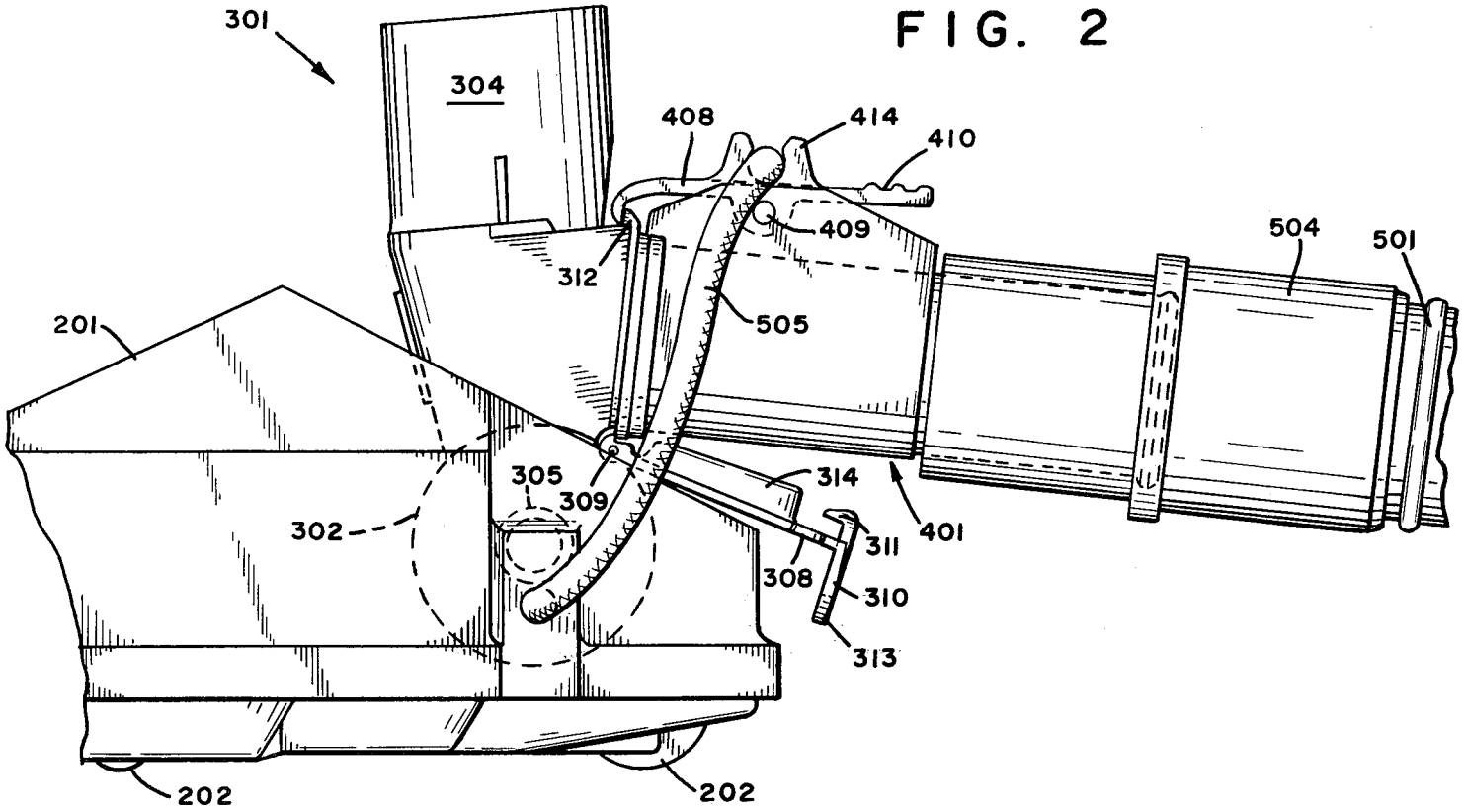
FIG. 2 comprises a side view of at least principal portions of the major components associated with the invention including, the floor nozzle, the swivel joint, the adaptor and associated parts.

Considering now more specifically FIG. 2, there will be seen therein, in more detail, the floor nozzle 201, the swivel joint 301 and the adaptor 401. A small portion of the hose 501 may be seen together with the cuff 504 which couples the hose 501 to the adaptor 401. If desired, the cuff 504 could be eliminated and the hose 501 coupled directly to the adaptor 401.

Figure 3:
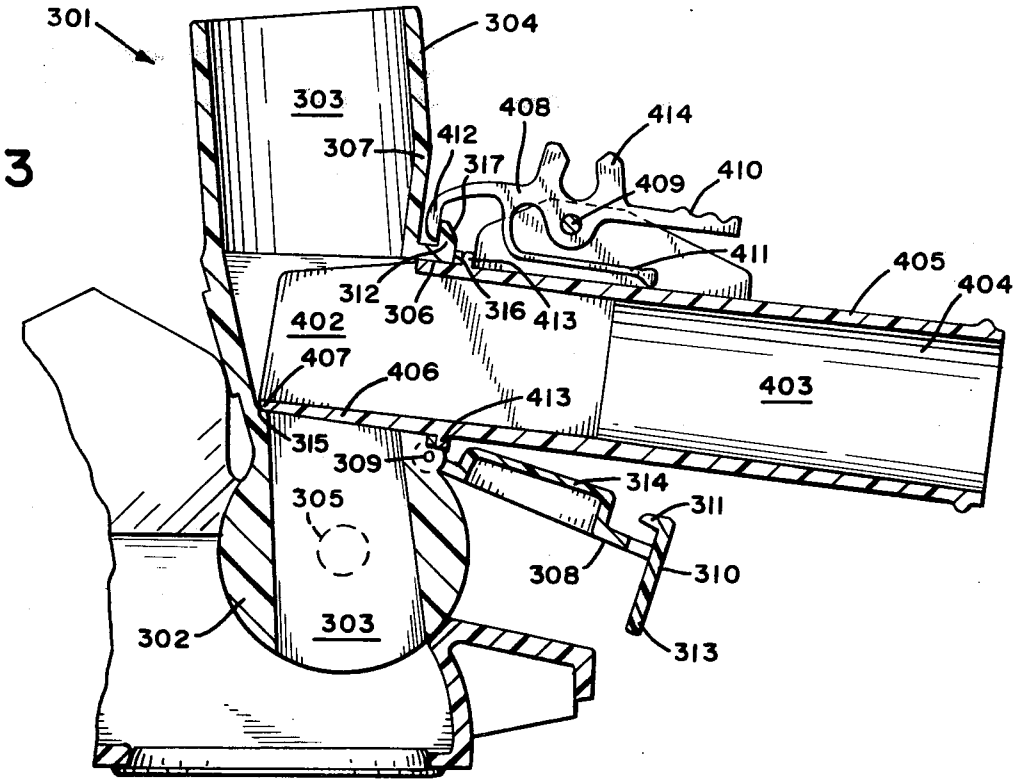
FIG. 3 comprises a cross section view of the principal components illustrated in FIG. 2.
Figure 4:
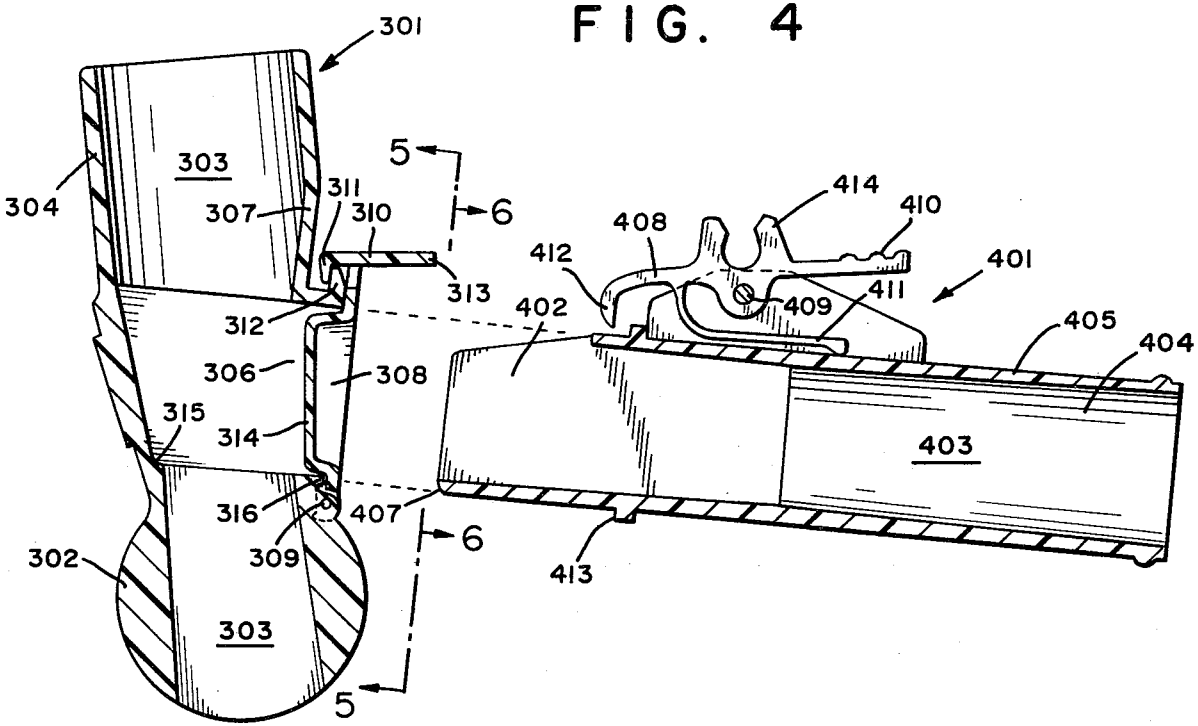
FIG. 4 comprises a cross section of the swivel joint and adaptor prior to their being positioned in cooperative engagement.

Considering now FIGS. 2, 3 and 4, it will be seen that the illustrated swivel joint 301 includes a cylindrical portion 302 which cooperates with and mates with the floor nozzle 201 in such manner that the swivel joint 301 may turn about the center line of the cylindrical portion 302. This allows the operator to maintain the bottom of the floor nozzle 201 against the floor while holding the handle 101 at any convenient angle with respect to the floor nozzle 201. It will be understood that other techniques may be employed for coupling the joint 301 to the nozzle 201. As seen most clearly in FIGS. 3 and 4, the swivel 301 has a passageway 303 extending there-through and coupled by connecting passageways within the floor nozzle 201 to the orifice on the underside thereof. Accordingly, it should be understood that when the cleaner 100 is in use as an upright cleaner, air and entrained dirt will pass through the passageway 303 from bottom to top, as seen in FIGS. 3 and 4 of the swivel 301. Typically, the swivel 301 may be coupled to a lower portion of the handle 101 with the handle fitting around the upper exterior 304 of the swivel 301.

Figure 5:
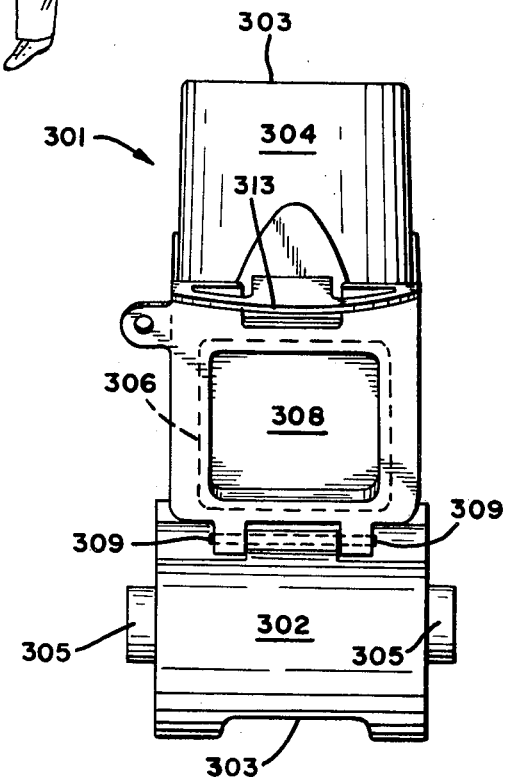
FIG. 5 comprises a view taken along the line 5—5 of FIG. 4.

FIG. 5 provides a view of the swivel 301 looking in the direction of the arrows 5—5 of FIG. 4. Comparing FIGS. 4 and 5, it is easy to see that the cylindrical portion 302 is cylindrical, as described. FIG. 5 shows bosses 305 which mate with portions of the floor nozzle 201 to provide the pivoting motion.

As may best be seen in FIG. 4, there is an opening 306 through the wall 307 of the swivel 301. The opening 306 is normally maintained closed by the cap or cover, or door 308 which is pivotally coupled to the swivel 301 at hinge pin 309. The cap 308 includes as an integral part thereof, a latch lever 310 including a hook 311 which, as shown, mates with and locks in cooperative engagement with the latch 312. The cap 308 and associated parts may be conveniently and economically fabricated of an acetal copolymer which while essentially rigid, can yield some when molded in thin sections. Accordingly, when pressure is applied to the end 313, in a downward direction as viewed in FIG. 4, the hook 311 will be lifted from the latch 312 thereby allowing the cap 308 to pivot about its hinge pin 309 thereby allowing it to asume the position shown in FIGS. 2 and 3. If desired, the cap 308 could be provided with a bias spring for biasing the cap 308 towards its closed position as illustrated in FIG. 4.

In order to improve the air flow through the passageway 303 and reduce turbulence, the cap 308 includes an innerwall 314 which is approximately coplanar with the wall 307. The lower end of the passageway 303 passing through the cylindrical portion 302 of the swivel 301 has a generally rectangular cross section. However, at the upper portion 304, the passageway is generally circular. In order to prevent clogging, the passageway 303 is generally smooth and it is desirable to avoid any abrupt change in cross sectional area of the passageway 303 as this might tend to obstruct the passage of various pieces of debris that are picked up by the cleaner. Note that a change of shape of the cross section of the passageway 303 is not detrimental, whereas a reduction in the cross sectional area could cause obstruction.

Figure 6:
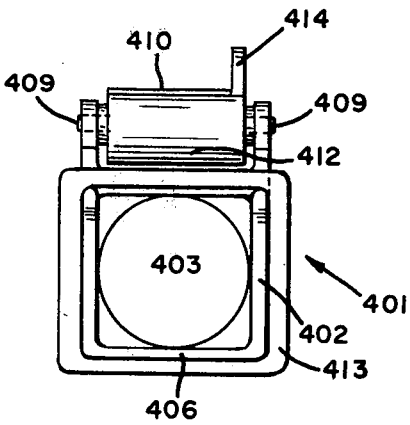
FIG. 6 comprises a view taken along the line 6—6 of FIG. 4.

Considering now FIG. 4, there will be seen the adaptor 401 which includes a forward portion 402 which, as will be seen, couples to the swivel 301 by inserting the forward portion 402 of the adaptor 401 through the opening 306 when the cap 308 is in the open position as illustrated in FIG. 3. There is a passageway 403 extending through the adaptor 401. It should be appreciated that the rearward portion 404 of the adaptor 401 has walls 405 completely surrounding the passageway 403. However, the forward portion 402 does not have a wall over the top of the forward end. That is, when viewing the adaptor 401 as seen in FIG. 6 and compared with FIGS. 3 and 4, it will be seen that the forward portion 402 has a U-shape. Accordingly, and as viewed in FIG. 3, the passageway 403 extends through the adaptor 401 from the rearward portion 404 to the forward portion 402 and then because of the open or U-shaped of the forward portion 402, the passageway 403 connects directly with the upper portion of the passageway 303 of the swivel. Accordingly, with the adaptor 401 plugged into the swivel 301, it will be evident that in response to suction from the motor section 102, air will be sucked through the hollow wand 502, the hose 501, to the passageway 403 and from there through the passageway 303 to the suction means 102.

It should be observed that the floor 406 of the forward portion 402 separates the upper and lower portions of the passageway 303 with respect to each other so that no suction is created through the orifice of the floor nozzle 201 into the passageway 303. It should be noted that this modification of the suction passageway was created by the mere act of plugging the adaptor 401 into the swivel joint 301 and that it was not necessary to actuate or activate any separate valves or mechanisms to alter the suction path.

It will be observed that the swivel 301 includes a ledge 315, best seen in FIG. 4, against which the forward edge 407, rests when the swivel 301 and adaptor 401 are placed in cooperative relationship. This helps to provide a seal to prevent suction through the lower end of the passageway 303. This improves efficiency and reduces losses.

As most clearly seen in FIG. 3, the adaptor 401 includes a lock lever 408 which is pivotally coupled to the adaptor 401 by hinge pin 409. The lock lever 408 includes a thumb actuator 410 and a spring 411 which biases a latch hook 412 which mates with the latch 312 of the swivel 301 when the adaptor 401 is inserted into the swivel 301. The thumb actuator 410 and spring 411 may be fabricated of acetylcopolymer or any other suitable material which exhibits the required combination of rigidity and yieldability to provide the spring and latch action. If desired, an independent spring could be used.

In order to improve the effectiveness of the seal between the adaptor 401 and the swivel 301, mating surfaces 413 and 316 are provided. If desired, the seal between these parts may be further enhanced by the use of a compressible gasket material such as foam rubber.

The thumb actuator 410 must be depressed to release the adaptor 401 from the swivel 301. However, the latch 312 may be provided with a cam surface 317 for raising the latch hook 412 as the adaptor is pushed into the swivel. The same cam surface 317 may be used to actuate the hook 311 as the cap 308 is moved to the closed position after removal of the adaptor 401.

As suggested previously, the floor nozzle 201 may include a motor (not shown) for driving a rotary brush. When this combination is used, it is typical for the power to be supplied to the motor by means of a wire 505 which exits from the floor nozzle 201 and is plugged into an outlet for a mating cord from the motor section 102. It is desirable to disconnect the wire 505 to terminate the action of any motor and rotary brush included with the floor nozzle 201 when the cleaner 100 is to be used as an above-the-floor cleaner. Normally, this would allow the wire 505 to drag on the floor and possibly become entanged with the wheels 202 or items of furniture as the cleaner is pulled from one position to another in response to force applied to the hose 501. In order to avoid this inconvenience, the thumb actuator 410 includes a cord grip 414 which will hold the wire 505 after it is disconnected from the motor section 102.

As may be appreciated from FIGS. 1 and 2, the adaptor 401 couples to the cleaner 100 at a point which is fairly close to the floor surface. As a consequence, it is possible to move the cleaner 100, when it is being used as an above for the floor cleaner, by pulling on the hose 501. If the adaptor 401 was connected to the cleaner 101 at a point at a higher level with respect to the floor, the cleaner 100 could not be moved in response to a pull on the hose 501 as it would probably tip over.

As most conveniently seen in FIG. 5, the opening 306 into the swivel 301 is generally rectangular as is the forward half 402 of the adaptor 401. The passageway 403 of the adaptor 401 changes from generally rectangular at the forward portion 402 to circular at the rearward portion 404.

Because the cap 308 is pivotally coupled to the swivel 301, there is no chance that it may be inadvertently misplaced and lost.

While there has been shown and described what is considered at present to be the preferred embodiment of the invention, modifications thereto will readily occur to those skilled in the related arts. For example, in another structure the cap 308 could be hinged at the top or side and/or plural latches could be provided. The swivel joint could have any of several other configurations to facilitate coupling to other operating handles and floor nozzles. It is believed that no further analysis or description is required and that the foregoing so fully reveals the gist of the present invention that those skilled in the applicable arts can adapt it to meet the exigencies of their specific requirements. It is not desired, therefore, that the invention be limted to the embodiments shown and described and it is intended to cover in the appended claims all such modifications as fall within the true spirit and scope of the invention.

What is claimed is:

1. A convertible upright vacuum cleaner which comprises a floor nozzle structure, a handle section with a suction motor and a filter bag, a swivel joint section coupling said handle section and nozzle structure, said swivel joint section being attached to and extending longitudinally from the lower end of said handle section, said swivel joint section having a first passageway for passing air and entrained dirt picked up from said nozzle, said first passageway extending in the longitudinal direction through said swivel joint section, a second passageway in said swivel joint section extending transversely to said first passageway, into said first passageway and intersecting said first passageway, said second passgeway and said first passageway where intersected by said second passageway being rectilinear in cross-section, an adaptor providing a connection to a cleaning wand at one end and having a section of rectilinear cross-section at the opposite end, the forward portion of said adaptor proximate to the opposite end thereof having a "U" shape closed at its base and sides and open at its top to close said first passageway at its base and provide a path for air and dirt from said wand through said adaptor into said handle section.

2. The convertible vacuum cleaner as set forth in claim 1, wherein said second passageway defines an opening into one side of said swivel joint section which is normally closed when said vacuum cleaner is used as an upright vacuum cleaner.

3. The convertible vacuum cleaner as set forth in claim 2 wherein said opening is maintained closed by a moveable door.

4. The convertible vacuum cleaner as set forth in claim 3 wherein said door is pivotally mounted to the wall of said joint.

5. The convertible vacuum cleaner as set forth in claim 4 wherein said opening may be maintained closed by a cooperating latch between said door and said joint.

6. The convertible vacuum cleaner as set forth in claim 1 wherein said adaptor and said joint include latching means for latching said joint and said adaptor in cooperative relationship.

7. The convertible vacuum cleaner as set forth in claim 6 wherein said opening is maintained closed by a moveable door having a rectilinear cross-sectional area depending from a rectilinear surrounding flange, which cross-sectional area enters said second passageway when said adaptor is not in cooperative relationship with said joint.

8. The combination as set forth in claim 7 wherein said door is pivotally mounted to the wall of said joint.

9. The combination as set forth in claim 8 wherein said opening may be maintained closed by a cooperating latch between said door and said joint.

10. The combination as set forth in claim 9 wherein said latching means includes at least part of said cooperating latch between said door and said joint.

11. The onvertible vacuum cleaner according to claim 1 wherein said joint is disposed at an end of said handle section, said intersecting portions of said passageways in said swivel joint section being disposed between said swivel joint and said suction motor.

12. The convertible vacuum cleaner according to claim 11 wherein the intersecting portions of said first and second passageways at the end thereof adjacent to said swivel joint whereon said adaptor base is received defines a ledge on which the forward edge of said base rests.

13. The convertible vacuum cleaner according to claim 11 wherein said first passageway is circular in cross-section at least on the side of said intersection portions of said first and second passageways closest to said suction motor, the transition between said rectilinear and circular cross-sections being of substantially the same area.

* * * * *